US009679460B2

(12) United States Patent
Yamanishi et al.

(10) Patent No.: US 9,679,460 B2
(45) Date of Patent: Jun. 13, 2017

(54) MONITORING SYSTEM

(71) Applicant: Panasonic Intellectual Property Management Co., Ltd., Osaka (JP)

(72) Inventors: Koji Yamanishi, Fukuoka (JP); Mitsuru Kawamura, Fukuoka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 3 days.

(21) Appl. No.: 14/663,304

(22) Filed: Mar. 19, 2015

(65) Prior Publication Data

US 2015/0269823 A1 Sep. 24, 2015

(30) Foreign Application Priority Data

Mar. 20, 2014 (JP) ..... 2014-058929

(51) Int. Cl.
*G08B 21/02* (2006.01)
*G08B 21/22* (2006.01)

(52) U.S. Cl.
CPC ..... *G08B 21/02* (2013.01); *G08B 21/22* (2013.01)

(58) Field of Classification Search
CPC ..... G08B 21/02; G08B 21/22; G08B 25/008; G08B 29/181; H04W 4/008; G07C 9/00103
See application file for complete search history.

(56) References Cited

U.S. PATENT DOCUMENTS

2010/0289644 A1 11/2010 Slavin et al.
2012/0019353 A1* 1/2012 Knasel ..... G05B 23/0229 340/4.35
2012/0158201 A1* 6/2012 Leeds ..... G08B 13/1418 700/293
2013/0278422 A1* 10/2013 Friedman ..... G08B 13/196 340/541
2015/0188725 A1* 7/2015 Coles ..... G08B 19/005 700/90

FOREIGN PATENT DOCUMENTS

| | | | |
|---|---|---|---|
| EP | 1 912 180 | A2 | 4/2008 |
| JP | 2004-133797 | A | 4/2004 |
| JP | 2005-327034 | A | 11/2005 |
| JP | 2006-244039 | A | 9/2006 |
| JP | 2008-310705 | A | 12/2008 |
| JP | 2009-093470 | A | 4/2009 |
| JP | 2010-233163 | A | 10/2010 |
| JP | 2010-258748 | A | 11/2010 |
| JP | 2013-207640 | A | 10/2013 |
| JP | 2014-208021 | A | 11/2014 |

OTHER PUBLICATIONS

International Search Report dated Jun. 2, 2015, for corresponding PCT Application No. PCT/JP2015/001263, 19 pages.

* cited by examiner

*Primary Examiner* — An T Nguyen
(74) *Attorney, Agent, or Firm* — Seed IP Law Group LLP

(57) ABSTRACT

An alert mode designation unit that sets an alert state when a mobile phone terminal is not located inside a communication zone with a master device, and sets an alert release state when the mobile phone terminal is located inside the communication zone with the master device, and an alert output unit that outputs an alarm if detection information from a sensor indicates an abnormal state when the alert state is set by the alert mode designation unit are included in the master device, and the alarm output unit does not output the alarm when the alert release state is set by the alert mode designation unit.

10 Claims, 13 Drawing Sheets

MONITORING SYSTEM

BACKGROUND OF THE INVENTION

1. Field of the Invention

The present invention relates to a monitoring system capable of achieving both security performance and convenience.

2. Description of the Related Art

Various systems used for, for example, crime prevention, security, or monitoring have been conventionally known.

In Japanese Patent Unexamined Publication No. 2010-233163, a telephone system has a security function of sending an outgoing call to another telephone terminal within the same system and controlling generation of an alarm using a response from the telephone terminal that is an outgoing call destination when a human sensor detects an intruder in a monitoring mode.

In Japanese Patent Unexamined Publication No. 2005-327034, a crime prevention device includes a master device, a voice slave device, and a crime prevention slave device. When the crime prevention slave device detects a change, the crime prevention slave device sends an abnormality notification to the master device. When a predetermined time lapses without the crime prevention slave device detecting the change, the crime prevention slave device sends a regular notification rather than abnormality to the master device.

In Japanese Patent Unexamined Publication No. 2004-133797, a security system determines whether an ID code included in an ID signal transmitted from a portable device including operation means is a regular ID code. The security system performs control to lock or unlock a door lock based on a result of the determination.

In Japanese Patent Unexamined Publication No. 2006-244039, a monitoring apparatus performs control not to prohibit shift from a monitoring mode to a monitoring release mode until a margin time lapses even when a user sets the monitoring mode to a monitoring set mode once in a release prohibition time zone.

In Japanese Patent Unexamined Publication No. 2008-310705, a control device of a security system performs control to transmit an intrusion abnormality signal to a monitoring center if any one of a specific sensor that detects a motion of a person and an outer periphery sensor that detects an intruder from the outside detects the motion or the intruder when a security mode is set to a security set mode. When the security mode is set to a presence-in-room set mode and if the specific sensor detects the motion within a predetermined time after the detection of the outer periphery sensor, the control device performs control to transmit an emergency signal to the monitoring center.

However, in the technologies disclosed by these literatures, both security performance and convenience are insufficient.

SUMMARY OF THE INVENTION

The present invention has been made in view of the aforementioned circumstances, and provides a communication system, a control device, and a control method capable of achieving both security performance and convenience.

There is provided a monitoring system including: a sensor; a master device capable of communicating with the sensor, the master device being connected to a fixed telephone network and capable of performing a telephone call with another fixed telephone; and a mobile phone terminal capable of wireless communication with the master device using a wireless router, the mobile phone terminal being connected to the other mobile phone over a mobile phone network, in which the master device includes a first communication unit that performs wireless communication with the mobile phone terminal via the wireless router; a second communication unit that receives detection information from the sensor; an alert mode designation unit that sets an alert state when the mobile phone terminal is not located inside a communication zone of wireless communication with the first communication unit of the master device, and sets an alert release state when the mobile phone terminal is located inside the communication zone of wireless communication with the first communication unit of the master device; and an alarm output unit that outputs an alarm if the detection information from the sensor indicates an abnormal state when the alert state is set by the alert mode designation unit, and the alarm output unit does not output the alarm when the alert release state is set by the alert mode designation unit.

According to the present invention, it is possible to achieve both security performance and convenience.

DETAILED DESCRIPTION OF THE PREFERRED EMBODIMENT

Hereinafter, an exemplary embodiment of the present invention will be described with reference to the drawings.

Process of Obtaining One Embodiment of the Present Invention

For example, in a home monitoring system, it is assumed that, when there is none in a family inside a house, a monitoring operation is performed, and when one in the family comes home, he or she performs a predetermined release operation within a predetermined time to release the monitoring operation.

In the conventional technologies, it is difficult to determine a predetermined time until the monitoring operation is released and, for example, a length of this time may change according to a situation. For example, when a waiting time is too long, a sufficient margin time is given to an intruder, and it is likely for damage to increase. On the other hand, when the waiting time is too short, it is highly likely for the monitoring system to erroneously recognize the person coming home as an intruder and report this fact before the person coming home completes the release operation. That is, when the waiting time is set to be long, performance of the monitoring system may be degraded, and when the waiting time is set to be short, convenience for a user may be degraded.

Hereinafter, a communication system, a control device, and a control method capable of achieving both security performance and convenience will be described.

Embodiments

Figure 1:
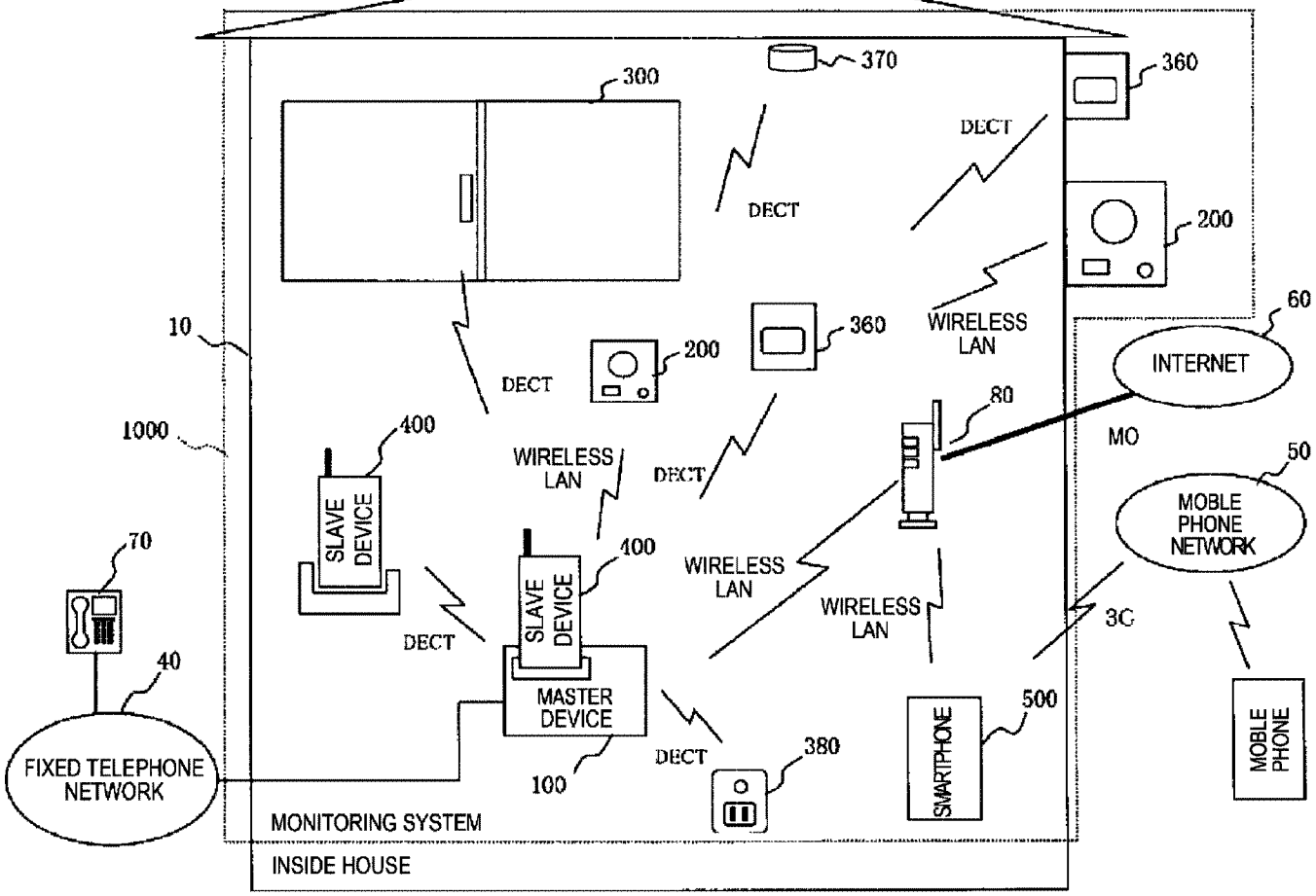
FIG. 1 is a block diagram illustrating a configuration example of a monitoring system in an exemplary embodiment.

FIG. 1 is a block diagram illustrating a configuration example of monitoring system 1000 in an exemplary embodiment. Monitoring system 1000 is used, for example, to monitor intrusion of a person other than a resident inside house 10 (for example, general house).

Monitoring system 1000 includes, for example, cordless phone master device 100, monitoring camera 200, opening and closing sensor 300, human sensor 360, smoke sensor 370, smart plug 380, and cordless phone slave device 400. Monitoring system 1000 may operate in cooperation with smartphone without including smartphone 500 or may include smartphone 500.

For example, cordless phone master device 100, monitoring camera 200, opening and closing sensor 300, human sensor 360, smoke sensor 370, smart plug 380, and cordless phone slave device 400 are arranged inside house 10. For example, monitoring camera 200, opening and closing sensor 300, human sensor 360, smoke sensor 370, smart plug 380, and cordless phone slave device 400 operate as slave devices of cordless phone master device 100.

Monitoring system 1000 is an example of the communication system. Smartphone 500 is an example of a portable terminal. Cordless phone master device 100 is an example of the control device. Monitoring camera 200, opening and closing sensor 300, human sensor 360, smoke sensor 370, and smart plug 380 are examples of a sensor.

In FIG. 1, a plurality of monitoring cameras 200 are installed in different positions. In FIG. 1, one of monitoring cameras 200 is installed, for example, inside house 10, and the inside of house 10 is included in an imaging range. Other monitoring camera 200 is installed, for example, on an outer wall or in the vicinity of house 10, and the vicinity of house 10 outside house 10 is included in an imaging range.

In FIG. 1, a plurality of human sensors 360 are installed in different positions. One of human sensors 360 is installed, for example, inside house 10, and the inside of house 10 is included in a detection range. Other human sensor 360 is installed, for example, on the outer wall or the vicinity of house 10, and the vicinity of house 10 outside the house is included in the detection range.

In FIG. 1, opening and closing sensor 300 is installed in the vicinity of a window that can be opened and closed. In FIG. 1, a plurality of cordless phone slave devices 400 are arranged in a range that can communicate with cordless phone master device 100.

For example, smartphone 500 and monitoring system 1000 operate in cooperation by information (for example, identification information) of smartphone 500 being registered in monitoring system 1000 (for example, cordless phone master device 100) in advance.

Smartphone 500 may connect to, for example, mobile phone network 50 via a 3G wireless communication line. Smartphone 500 may be connected to, for example, a wireless router 80 via a communication line of a wireless LAN (Local Area Network).

Cordless phone master device 100 is connected to a fixed telephone network 40. For example, cordless phone master device 100 may be connected to wireless router 80 via the wireless LAN. Wireless router 80 is connected to Internet 60.

Therefore, smartphone 500 can communicate with cordless phone master device 100 via wireless router 80 using the wireless LAN inside house 10. Smartphone 500 can communicate with cordless phone master device 100 via the 3G wireless communication line, mobile phone network 50 and fixed telephone network 40 at an arbitrary place outside the house.

For example, cordless phone master device 100, opening and closing sensor 300, human sensor 360, smoke sensor 370, smart plug 380, and cordless phone slave device 400 have a wireless communication function conforming to a DECT (Digital Enhanced Cordless Telecommunications) standard.

Therefore, cordless phone master device 100 can perform wireless communication (for example, DECT communication) with opening and closing sensor 300, human sensor 360, smoke sensor 370, smart plug 380, and cordless phone slave device 400. Cordless phone master device 100, for example, manages the DECT communication of cordless phone master device 100 and a plurality of slave devices (reference signs 300, 360, 370, and 400) according to a TDMA (Time Division Multiple Access) communication scheme.

Cordless phone master device 100 and monitoring camera 200 have a wireless LAN communication function. Therefore, cordless phone master device 100 can wirelessly communicate with monitoring camera 200 via wireless router 80 or directly.

Opening and closing sensor 300 detects, for example, an opening and closing state of the window or a door, and transmits detection information (sensor detection information) indicating a detection result, for example, to cordless phone master device 100. Human sensor 360 detects presence or absence of a person inside or outside house 10 and transmits detection information indicating a detection result, for example, to cordless phone master device 100. Smoke sensor 370 detects presence or absence of smoke and transmits detection information indicating a detection result, for example, to cordless phone master device 100. Smart plug 380, for example, measures an amount of used power inside house 10, and transmits the amount of used power to cordless phone master device 100.

Monitoring system 1000 includes one or a plurality of human sensors 360. For example, human sensor 360 inside the house detects a person inside house 10. For example, human sensor 360 outside the house detects, for example, a person outside house 10 in the vicinity of the house. Using human sensor 360, a suspicious person approaching house 10 or an intruder intruding into house 10 can be detected.

Monitoring system 1000 includes one or a plurality of opening and closing sensors 300. While a case in which opening and closing sensor 300 is installed at the window is illustrated in FIG. 1, opening and closing sensor 300 may be installed to detect an opening and closing state of other places (for example, an opening of a building (for example, an entrance door)). Using opening and closing sensor 300, presence or absence of the intruder can be detected.

Next, a configuration example of cordless phone master device 100 will be described.

Figure 2:
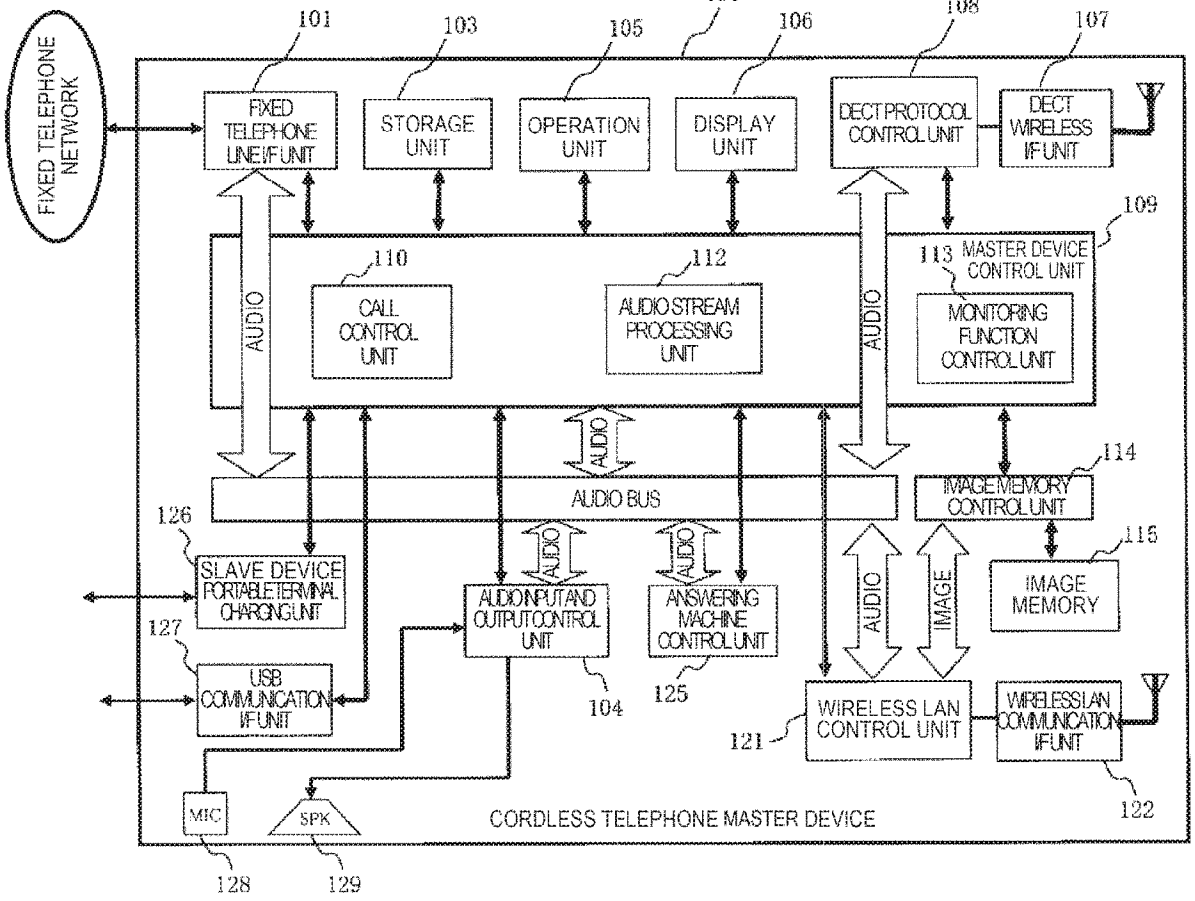
FIG. 2 is a block diagram illustrating a configuration example of a cordless phone master device in the exemplary embodiment.

FIG. 2 is a block diagram illustrating a configuration example of cordless phone master device 100.

Cordless phone master device 100 includes fixed telephone line I/F (Interface) unit 101, storage unit 103, audio input and output control unit 104, operation unit 105, display unit 106, DECT wireless I/F unit 107, and DECT protocol control unit 108. Cordless phone master device 100 includes master device control unit 109, image memory control unit 114, image memory 115, wireless LAN control unit 121, wireless LAN communication I/F unit 122, answering machine control unit 125, and slave device/portable terminal charging unit 126. Cordless phone master device 100 includes USB (Universal Serial Bus) communication I/F unit 127, microphone (MIC) 128, and speaker (SPK) 129.

Master device control unit 109 includes call control unit 110, audio stream processing unit 112, and monitoring function control unit 113.

Wireless LAN control unit 121 and wireless LAN communication I/F unit 122 are an example of a first communication unit of the control device. DECT wireless I/F unit 107 and DECT protocol control unit 108 are an example of a second communication unit of the control device.

Fixed telephone line I/F unit 101 includes a line control circuit (NCU: Network Control Unit), and a modem. The NCU controls a telephone line and, for example, detects an incoming call from fixed telephone network 40 and connects fixed telephone network 40 in a capturing manner at the time of outgoing call. The modem receives, for example, caller identification information or the like from fixed telephone network 40 at the time of incoming call. Fixed telephone line I/F unit 101 is not limited to connection to an analog telephone line according to a configuration of the line control circuit and may be connected to a digital telephone line (for example, ISDN (Integrated Service Digital Network) line or an IP telephone line).

Storage unit 103 includes, for example, a volatile memory (RAM: Random Access Memory) or a nonvolatile memory (for example, a ROM (Read Only Memory) or an EPROM (Erasable Programmable ROM)). Storage unit 103 stores, for example, various programs, and various pieces of information (for example, various parameters for determining operation conditions of cordless phone master device 100, telephone book information, incoming and outgoing call history information).

Audio input and output control unit 104 performs control to convert audio data converted to a digital signal from an audio bus, to an analog signal, and output the analog signal to speaker 129. Audio input and output control unit 104 may perform, for example, volume output control or voice quality control in response to an instruction from master device control unit 109. Audio input and output control unit 104 performs control to convert analog audio acquired from microphone 128 to digital audio and send the digital audio to the audio bus. Audio input and output control unit 104 is used, for example, when a hands-free call is performed using microphone 128 and speaker 129. For example, a ringtone and music data may be included in the audio data output to speaker 129, in addition to the call voice.

Operation unit 105 includes, for example, a plurality of buttons that can be operated by the user, and receives an operation input. For example, a dial key necessary for dial input at the time of outgoing call, and a key necessary to operate monitoring system 1000 are included in the buttons. The key for operating monitoring system 1000 includes, for example, a key that switches ON and OFF of an "alert mode" to be described below, and a key that inputs a password for person authentication.

Display unit 106 includes, for example, a liquid crystal display, and a driver of the liquid crystal display, and includes a screen that can display visible information (for example, letters, numbers, or signs). Display unit 106 displays, for example, a phone number, information of a communication destination or a communication source, operation guidance information, or ON and OFF information of an "alert mode."

DECT wireless I/F unit 107 includes, for example, a transmission and reception circuit that is suitable for a DECT standard for performing wireless communication with the slave device of cordless phone master device 100. The slave device of cordless phone master device 100 includes, for example, cordless phone slave device 400, opening and closing sensor 300, human sensor 360, smoke sensor 370, or smart plug 380. DECT wireless I/F unit 107 communicates a radio signal via an antenna using an RF (Radio Frequency) unit (not illustrated). DECT wireless I/F unit 107 receives, for example, sensor detection information from various sensors.

DECT protocol control unit 108 includes a protocol stack unit that communicates data with the slave device of cordless phone master device 100, and performs protocol control according to a protocol scheme of the DECT standard.

Master device control unit 109 includes, for example, hardware including a microcomputer as a main entity, and realizes various functions of master device control unit 109 by realizing a program incorporated in advance. Master device control unit 109 controls entire cordless phone master device 100.

Call control unit 110 processes an event or various messages notified of from operation unit 105, fixed telephone line I/F unit 101, or DECT protocol control unit 108 (each slave device), and performs state management of a call generated in cordless phone master device 100, and call connection. Further, the state management of the call includes, for example, detection of an outgoing call or an incoming call. Further, call control unit 110 performs, for example, control of output or stop of a ringtone.

Audio stream processing unit 112 performs connection procedure control for audio stream communication, and outputs transmitted audio stream data to speaker 129. Audio stream processing unit 112 forms, for example, an audio path for transferring audio stream data, which is transmitted from the slave device of cordless phone master device 100, from DECT protocol control unit 108 to audio input and output control unit 104. Audio stream processing unit 112 forms, for example, an audio path for transferring audio stream data, which is transmitted from monitoring camera 200, from wireless LAN control unit 121 to audio input and output control unit 104.

When audio stream processing unit 112 forms the audio path from DECT protocol control unit 108 to audio input and output control unit 104, audio stream processing unit 112 may buffer the stream data. When audio stream processing unit 112 forms the audio path from wireless LAN control unit 121 to audio input and output control unit 104, audio stream processing unit 112 may buffer the stream data.

Monitoring function control unit 113 performs various controls according to monitoring of monitoring system 1000. Monitoring function control unit 113 performs, for example, a security setting of monitoring system 1000. The security setting includes a setting (ON or OFF) of the alert mode. An ON state of the alert mode is a mode in which alert of monitoring system 1000 is necessary and is an example of the alert state. The OFF state of the alert mode is a mode in which the alert of monitoring system 1000 is unnecessary and is an example of an alert release state. The alert mode may be set, for example, according to the sensor detection information from various sensors, may be set by a user operation, or may be set using a known method. Information of the security setting is held, for example, in an internal memory of monitoring function control unit 113. Therefore, monitoring function control unit 113 functions as an alert mode designation unit that designates the alert mode.

Monitoring function control unit 113 outputs an alarm, for example, when a mode is the alert mode and an abnormal state continues for a predetermined time or longer in a monitoring target region (for example, in the inside of house 10). The output of the alarm is performed, for example, through display, audio output, or vibration.

The abnormal state is a state in which various sensors indicate abnormality. For example, when the sensor is opening and closing sensor 300, the abnormal state includes an open state. For example, when the sensor is human sensor 360, the abnormal state includes a state in which a person is detected. For example, when the sensor is smoke sensor 370, the abnormal state includes a state in which smoke is detected. For example, when the sensor is smart plug 380, the abnormal state includes a state in which an amount of used power inside house 10 is equal to or larger than a predetermined amount.

For example, monitoring function control unit 113 controls a length of an alarm output time according to whether smartphone 500 is located inside the communication zone of the wireless LAN inside house 10 or not. For example, the alarm output time is a time from detection of abnormality in the various sensors to output of the alarm in monitoring system 1000. Therefore, monitoring function control unit 113 functions as a time control unit.

Image memory 115 includes, for example, a nonvolatile memory having a relatively large storage capacity, and stores image data to be obtained by monitoring camera 200. Image memory control unit 114 performs, for example, control to write and store the image data output from wireless LAN control unit 121 to and in image memory 115 in response to an instruction of monitoring function control unit 113.

Wireless LAN control unit 121 and wireless LAN communication I/F unit 122 connect to an external wireless LAN device according to IEEE802.11, that is, a wireless LAN standard, and perform data communication with the external wireless LAN device.

Answering machine control unit 125, for example, stores an answering machine message, and controls recording and reproduction of the message.

Slave device/portable terminal charging unit 126 charges, for example, a rechargeable battery mounted on cordless phone slave device 400, opening and closing sensor 300, smartphone 500, or other portable terminals. Slave device/portable terminal charging unit 126 may include a docking unit on which a charging target terminal is placed, and a charging terminal to perform charging. For example, the slave device/portable terminal charging unit 126 may be a charging unit corresponding to a Qi (chi) standard that is a wireless power supply standard to perform wireless power supply.

USB communication I/F unit 127 is a communication interface that connects various devices corresponding to a USB standard to cordless phone master device 100. For example, USB communication I/F unit 127 may operate as a power supply unit that supplies power to cordless phone slave device 400 or smartphone 500.

Next, a configuration example of monitoring camera 200 will be described.

Figure 3:
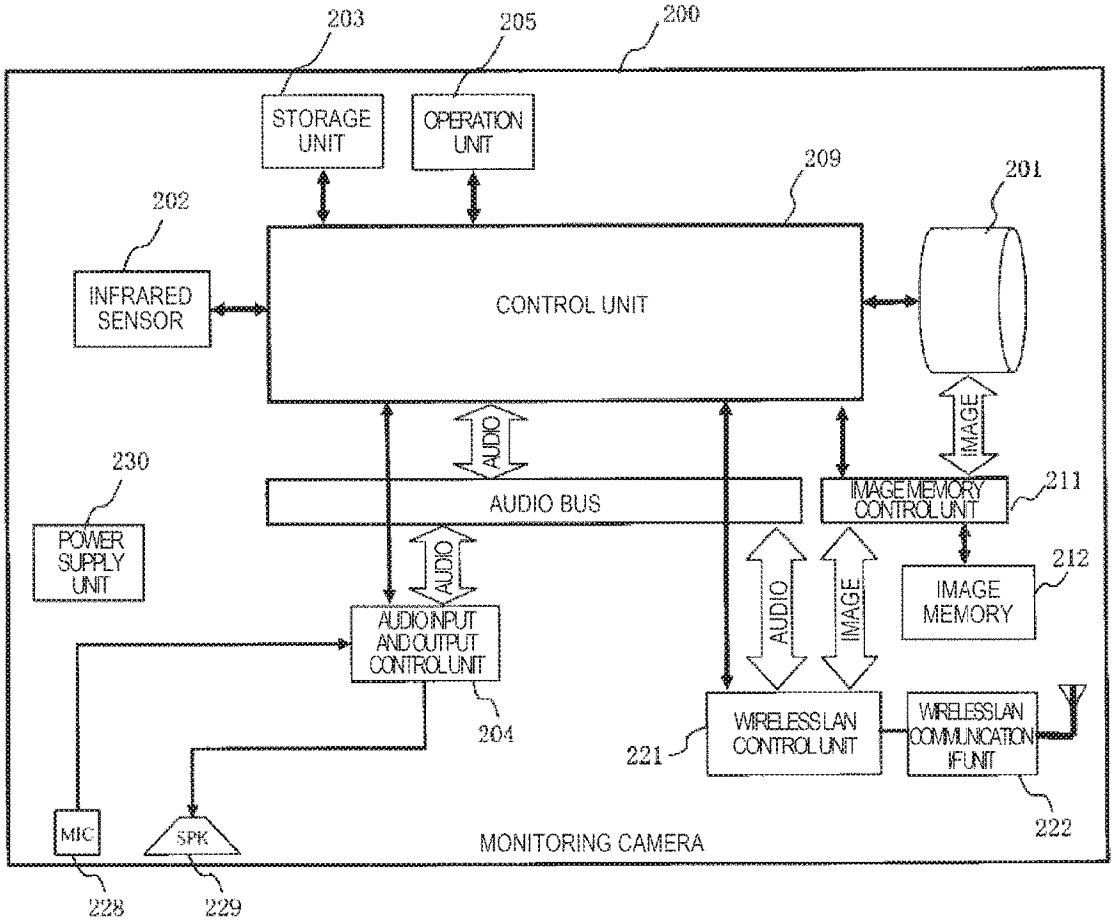
FIG. 3 is a block diagram illustrating a configuration example of a monitoring camera in the exemplary embodiment.

FIG. 3 is a block diagram illustrating a configuration example of monitoring camera 200.

Monitoring camera 200 includes imaging unit 201, infrared sensor 202, storage unit 203, audio input and output control unit 204, operation unit 205, control unit 209, image memory control unit 211, and image memory 212. Monitoring camera 200 includes wireless LAN control unit 221, wireless LAN communication I/F unit 222, microphone (MIC) 228, speaker (SPK) 229, and power supply unit 230.

Imaging unit 201 includes an imaging device (for example, a CCD (Charge Coupled Device) image sensor or a CMOS (Complementary Metal Oxide Semiconductor) image sensor). Imaging unit 201 images, for example, a monitoring target region (for example, the inside of house 10 or the outside of house 10). An image captured by imaging unit 201 is output as image data of a moving image or a still image.

Infrared sensor 202 detects presence or absence of an object (for example, a person) that emits infrared rays in the monitoring target region or the vicinity thereof.

Storage unit 203 includes, for example, a volatile memory (RAM) or a nonvolatile memory (ROM/EPROM). Storage unit 203 stores, for example, various programs, and various parameters that determine operation conditions of monitoring camera 200.

Audio input and output control unit 204 performs control to convert audio data which is a digital signal from an audio bus to an analog signal, and output the analog signal to speaker 229. Audio input and output control unit 204 may perform volume output control or voice quality control in response to an instruction from master device control unit 109. Audio input and output control unit 204 performs control to convert an analog audio acquired from microphone 228 into digital audio and send the digital audio to the audio bus. Audio input and output control unit 204 acquires, for example, an abnormal noise or the like generated in the monitoring target region or the vicinity thereof from microphone 228, and generates audio data for monitoring. Audio input and output control unit 204 outputs, for example, an alarm voice message to an intruder using speaker 229.

Operation unit 205 includes a plurality of buttons that can be operated by a user, and receives an operation input. For example, an operation mode of monitoring camera 200 is switched, and adjustment of an imaging period and imaging sensitivity of imaging unit 201, sensitivity of microphone 228, and a volume of speaker 229 are instructed by operating operation unit 205.

Control unit 209 includes, for example, hardware including a microcomputer as a main entity, and realizes various functions of control unit 209 by executing a program incorporated in advance. Control unit 209 controls entire monitoring camera 200.

For example, control unit 209 performs control to transmit the image data obtained by imaging unit 201 and the audio data obtained by microphone 228 to cordless phone master device 100 via the wireless LAN. The image data may be accumulated in image memory 212 inside monitoring camera 200. Control unit 209 may output a voice message from speaker 229, as necessary.

Image memory 212 includes, for example, a nonvolatile memory having a relatively large storage capacity and stores the image data to be obtained by imaging unit 201. For example, in response to an instruction of control unit 209, image memory control unit 211 performs control to write and store the image data output from imaging unit 201 to and in image memory 212.

Wireless LAN control unit 221 and wireless LAN communication I/F unit 222 connect to an external wireless LAN device according to IEEE802.11, that is, a wireless LAN standard, and perform data communication with the external wireless LAN device.

Power supply unit 230 supplies power supply power to each unit in monitoring camera 200.

Next, a configuration example of opening and closing sensor 300 will be described.

Figure 4:
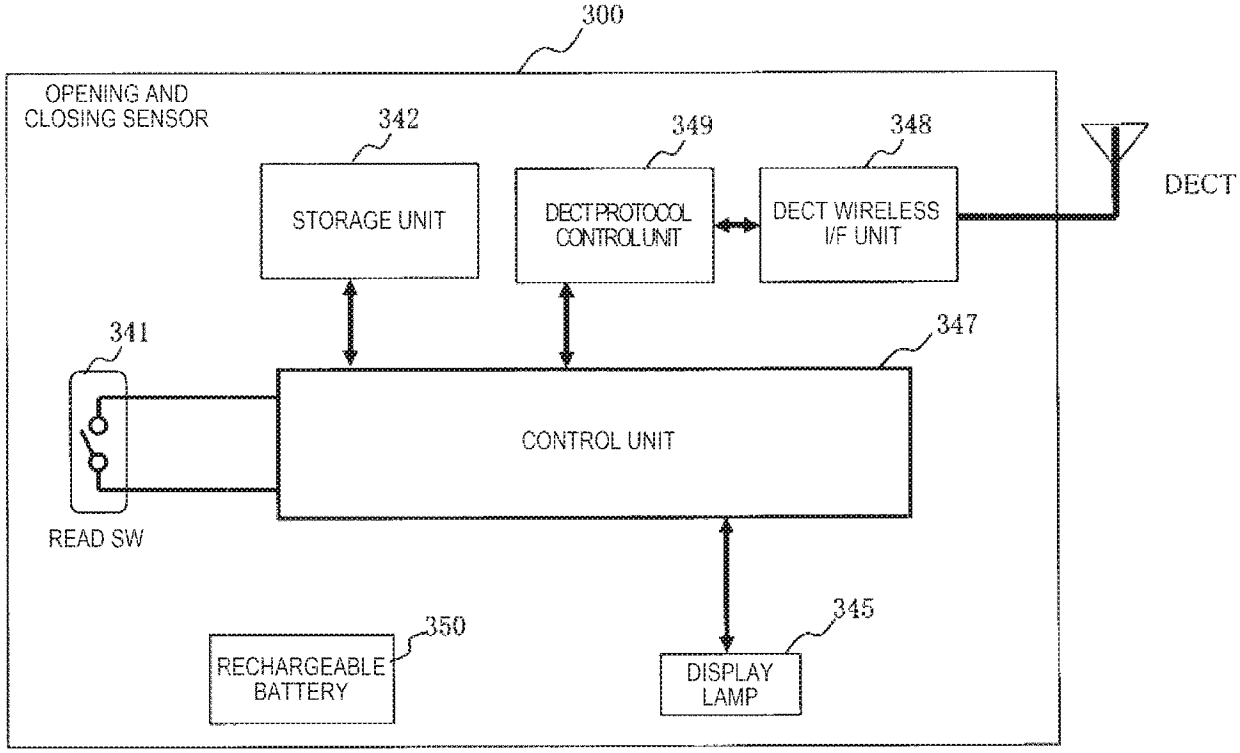
FIG. 4 is a block diagram illustrating a configuration example of an opening and closing sensor in the exemplary embodiment.

FIG. 4 is a block diagram illustrating a configuration example of opening and closing sensor 300.

Opening and closing sensor 300 includes reed switch 341, storage unit 342, display lamp 345, control unit 347, DECT wireless I/F unit 348, DECT protocol control unit 349, and rechargeable battery 350. DECT wireless I/F unit 348 and DECT protocol control unit 349 are an example of a transmission unit of the sensor. Lead switch 341 is an example of a detection unit.

Lead switch 341, for example, is fixed in a position adjacent to a movement range of a permanent magnet (not illustrated) installed in a movable unit that opens and closes an opening (for example, a window). In reed switch 341, electric contacts are turned ON or OFF according to an opening and closing state of the opening, and opening or closing is detected.

Storage unit 342 includes, for example, a volatile memory (RAM) or a nonvolatile memory (ROM/EPROM). Storage unit 342 stores, for example, various programs, and various parameters that determine operation conditions of opening and closing sensor 300.

Display lamp 345 enters, for example, a lighting, extinguishing, or blinking state in response to an instruction of control unit 347. Display lamp 345 reports, for example, an ON and OFF state of reed switch 341 or a communication state of opening and closing sensor 300 through display.

Control unit 347 includes, for example, hardware including a microcomputer as a main entity, and realizes various functions of opening and closing sensor 300 by executing a program incorporated in advance. Control unit 347 controls entire opening and closing sensor 300.

DECT wireless I/F unit 348 includes a transmission and reception circuit suitable for a DECT standard for performing wireless communication with cordless phone master device 100. DECT wireless I/F unit 348 communicates a radio signal via an antenna using an RF unit (not illustrated).

DECT protocol control unit 349 includes a protocol stack unit that communicates data with cordless phone master device 100, and performs protocol control according to a protocol scheme of the DECT standard.

Rechargeable battery 350 supplies power supply power to each unit in opening and closing sensor 300.

Therefore, opening and closing sensor 300 can transmit information indicating ON and OFF of reed switch 341, that is, detection information of opening and closing sensor 300 to cordless phone master device 100 through DECT communication. Although not illustrated, human sensor 360 and smoke sensor 370 can transmit detection information to cordless phone master device 100 through DECT communication, similarly to opening and closing sensor 300.

Next, a configuration example of cordless phone slave device 400 will be described.

Figure 5:
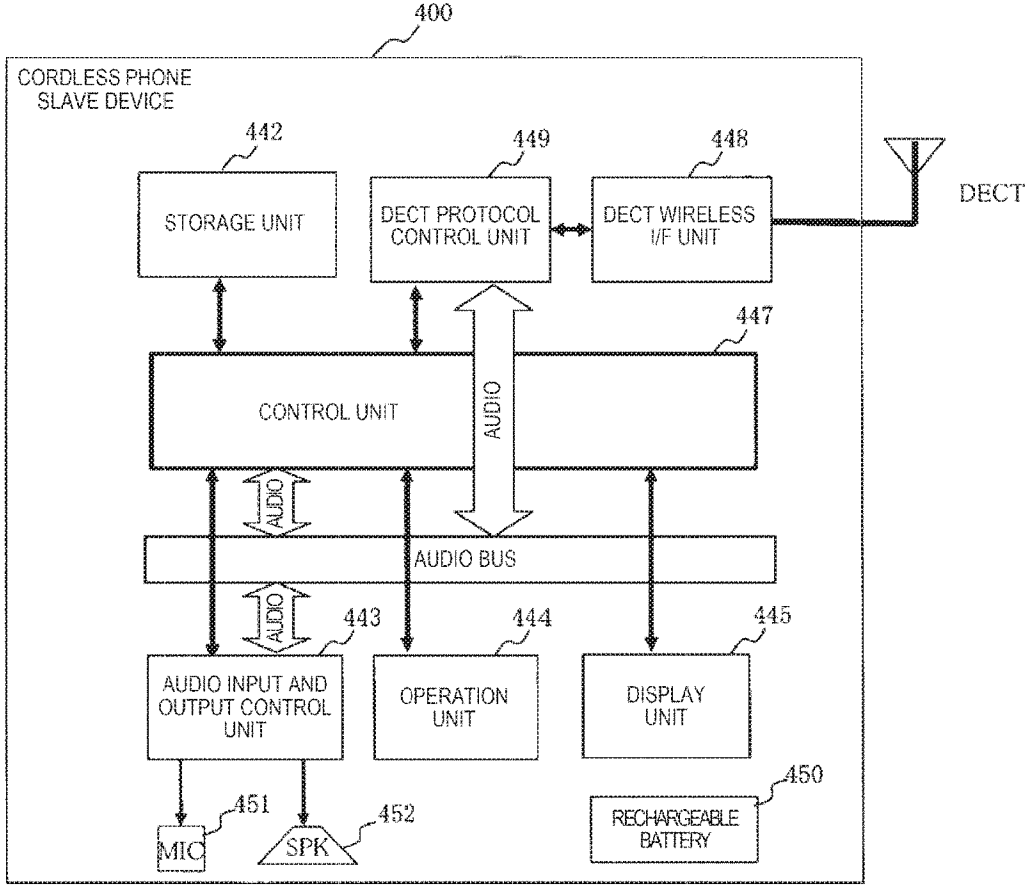
FIG. 5 is a block diagram illustrating a configuration example of a cordless phone slave device in the exemplary embodiment.

FIG. 5 is a block diagram illustrating a configuration example of cordless phone slave device 400.

Cordless phone slave device 400 includes storage unit 442, audio input and output control unit 443, operation unit 444, display unit 445, control unit 447, DECT wireless I/F unit 448, DECT protocol control unit 449, rechargeable battery 450, microphone (MIC) 451, and speaker (SPK) 452.

Storage unit 442 includes, for example, a volatile memory (RAM) or a nonvolatile memory (ROM/EPROM). Storage unit 442 stores various programs, and various pieces of information (for example, various parameters that determine operation conditions of cordless phone slave device 400, telephone book information, or incoming and outgoing call history information).

Audio input and output control unit 443 performs control to convert audio data which is a digital signal from an audio bus to an analog signal, and output the analog signal to speaker 452. Audio input and output control unit 443 may perform, for example, volume output control or voice quality control in response to an instruction from control unit 447. Audio input and output control unit 443 performs control to convert the analog audio acquired from microphone 451 into digital audio and send the digital audio to an audio bus. Audio input and output control unit 443 is used, for example, when a hands-free call is performed using microphone 451 and speaker 452. For example, a ringtone and music data may be included in the audio data output to speaker 452, in addition to call voice.

Operation unit 444 includes, for example, a plurality of buttons that can be operated by a user, and receives an operation input. For example, a dial key necessary for dial input at the time of outgoing call, and various keys necessary for an operation of voice call are included in the buttons.

Display unit 445 includes, for example, a liquid crystal display, and a driver of the liquid crystal display, and includes a screen that can display visible information (for example, letters, numbers, or signs). Display unit 445 displays, for example, a phone number, information of a communication destination or a communication source, or operation guidance information.

Control unit 447 includes, for example, hardware including a microcomputer as a main entity, and realizes various functions of cordless phone slave device 400 by executing a program incorporated in advance. Control unit 447 controls entire cordless phone slave device 400.

DECT wireless I/F unit 448 includes a transmission and reception circuit that is suitable for the DECT standard for performing wireless communication with cordless phone master device 100. DECT wireless I/F unit 448 communicates a radio signal via an antenna by an RF unit (not illustrated).

DECT protocol control unit 449 includes a protocol stack unit that communicates data with cordless phone master device 100, and performs protocol control according to a protocol scheme of the DECT standard.

Rechargeable battery 450 supplies power supply power to each unit in cordless phone slave device 400.

Next, a configuration example of smartphone 500 will be described.

Figure 6:
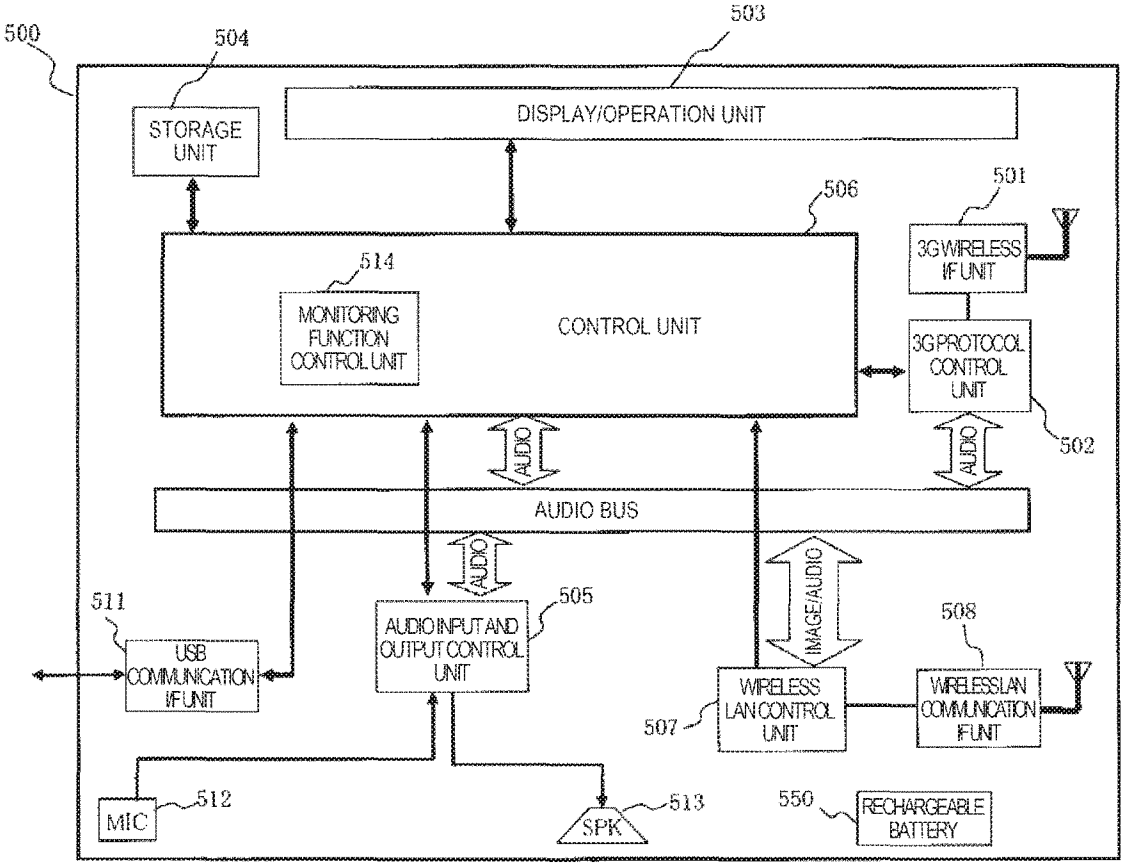
FIG. 6 is a block diagram illustrating a configuration example of a smartphone in the exemplary embodiment.

FIG. 6 is a block diagram illustrating a configuration example of smartphone 500.

Smartphone 500 includes 3G wireless I/F unit 501, 3G protocol control unit 502, display/operation unit 503, storage unit 504, audio input and output control unit 505, control unit 506, wireless LAN control unit 507, wireless LAN communication I/F unit 508, USB communication I/F unit 511, microphone (MIC) 512, and speaker (SPK) 513. Wireless LAN control unit 507 and wireless LAN communication I/F unit 508 are an example of a communication unit of the portable terminal.

Control unit 506 includes monitoring function control unit 514. For example, monitoring function control unit 514 remotely controls a security setting (including a setting of the alert mode) of monitoring system 1000. For example, when an input of an instruction to turn the alert mode ON is received by display/operation unit 503, control is performed to transmit instruction information for turning the alert mode ON to cordless phone master device 100. For example, when an input of an instruction to turn the alert mode OFF is received by display/operation unit 503, control is performed to transmit instruction information for turning the alert mode OFF to cordless phone master device 100.

3G wireless I/F unit 501 includes, for example, a transmission and reception circuit necessary to perform wireless communication conforming to an "IMT-2000" (International Mobile Telecommunication 2000) standard defined in the International Telecommunications Union (ITU).

3G protocol control unit 502 includes a protocol stack unit that communicates data with a partner terminal over mobile phone network 50 corresponding to "IMT-2000," and performs protocol control according to a protocol scheme of "IMT-2000."

Display/operation unit 503 includes, for example, a liquid crystal display, and a transparent touch panel arranged to overlap a screen of the liquid crystal display. For example, visible information (for example, letters, numbers, signs, or images) is displayed on the screen of the liquid crystal display. For example, a large number of buttons are assigned to respective areas of the touch panel according to screen display content of the liquid crystal display.

Display/operation unit 503 displays, for example, a dial key necessary for dial input, and various keys necessary for an operation of voice call. An area for receiving a key input is assigned to each area of the touch panel in a position matching each key. Display/operation unit 503 receives an input to each area of the touch panel.

When smartphone 500 and monitoring system 1000 cooperate, for example, display/operation unit 503 may display the image captured by monitoring camera 200 of monitoring system 1000. When smartphone 500 and monitoring system 1000 cooperate, for example, display/operation unit 503 may receive inputs to keys necessary to operate monitoring system 1000. For example, a key for a monitoring instruction, a "Speaker" key, and a "Mute" key (see FIG. 7) are included in the keys for operating monitoring system 1000. The monitoring instruction includes, for example, a request to transmit an image of a monitoring target.

Storage unit 504 includes, for example, a volatile memory (RAM) and a nonvolatile memory (ROM/EPROM). For example, storage unit 504 stores various programs, and various pieces of information (for example, various parameters for determining operation conditions of smartphone 500, telephone book information, or incoming and outgoing call history information).

Audio input and output control unit 505 performs control to convert audio data which is a digital signal from an audio bus to an analog signal, and output the analog signal to speaker 513. Audio input and output control unit 505 may perform, for example, volume output control or voice quality control in response to an instruction from control unit 506. Audio input and output control unit 505 performs control to convert analog audio acquired from microphone 512 into digital audio and send digital audio to the audio bus. Audio input and output control unit 505 is used when a hands-free call is performed using microphone 512 and speaker 513. For example, a ringtone, music data, and audio data collected by monitoring system 1000 may be included in the voice signal output to speaker 513, in addition to the call voice.

Control unit 506 includes, for example, hardware including a microcomputer as a main entity and realizes various functions of smartphone 500 by executing a program incorporated in advance. Control unit 506 controls entire smartphone 500.

Monitoring function control unit 514 of control unit 506 is a unit for cooperating with monitoring system 1000, and executes, for example, an application program for monitoring system 1000. Monitoring function control unit 514 performs, for example, control necessary for an operation illustrated in FIG. 7 to be described below, and control illustrated in FIG. 11 to be described below. These controls will be described below in detail.

Wireless LAN control unit 507 and wireless LAN communication I/F unit 508 connect to an external wireless LAN device according to IEEE802.11, that is, a wireless LAN standard, and perform data communication with the external wireless LAN device.

USB communication I/F unit 511 is a communication interface for connecting various devices (for example, cordless phone master device 100) corresponding to the USB standard to smartphone 500. USB communication I/F unit 511 may operate as, for example, a power supply unit that supplies power from cordless phone master device 100 to smartphone 500.

Next, an operation example of monitoring system 1000 will be described.

Figure 7:
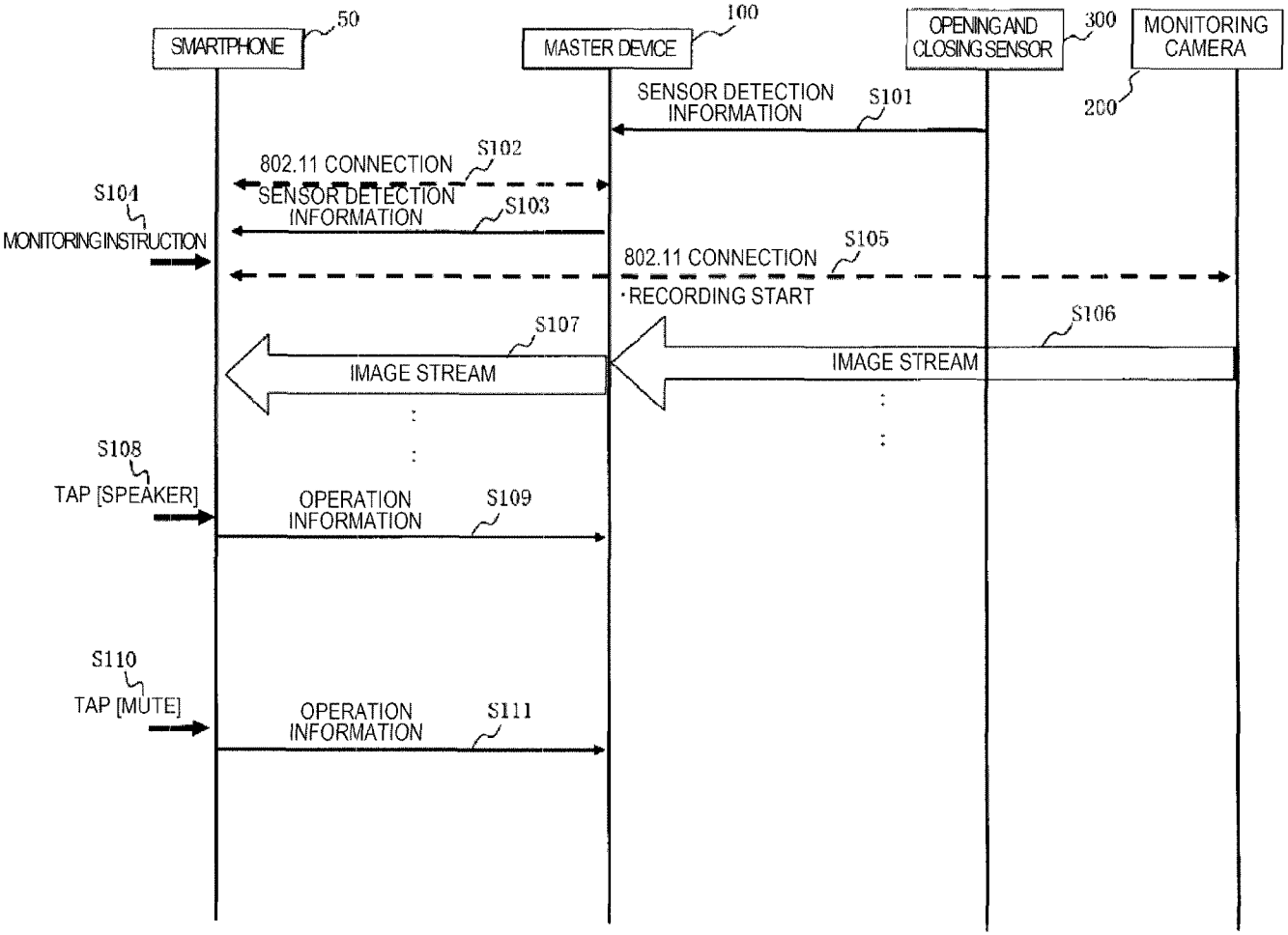
FIG. 7 is a sequence diagram illustrating an operation example of the monitoring system in the exemplary embodiment.

FIG. 7 is a sequence diagram illustrating a basic operation example when cordless phone master device 100 cooperates with smartphone 500.

In opening and closing sensor 300, periodically or when a detection state of reed switch 341 is changed, control is performed so that DECT protocol control unit 349 transmits sensor detection information indicating the detection state (the open state or the closed state) to cordless phone master device 100 (S101).

In this exemplary embodiment, controlling for transmission is also merely described as transmission. Controlling for reception is also merely described as reception.

It is assumed that smartphone 500 is inside house 10 and is inside the communication zone (for example, a Wifi (registered trademark) zone) of the wireless LAN (IEEE802.11) inside house 10 formed by wireless router 80, as illustrated in FIG. 1. In this state, when cordless phone master device 100 receives the sensor detection information, control is performed so that wireless LAN control unit 507 of smartphone 500 and wireless LAN control unit 121 of cordless phone master device 100 perform wireless connection (also referred to as Wifi (registered trademark) connection or 802.11 connection) (S102).

That is, cordless phone master device 100 is connected to smartphone 500 via the wireless LAN and wireless router 80.

Wireless LAN control unit 121 of cordless phone master device 100 transmits the sensor detection information from opening and closing sensor 300 to smartphone 500 through wireless LAN communication (for example, Wifi (registered trademark) communication) (S103). In this case, wireless LAN control unit 121, for example, may perform control to transmit the sensor detection information when it is authenticated that smartphone 500 is a smartphone 500 of a specific user who has been registered in cordless phone master device 100 in advance.

In smartphone 500, wireless LAN control unit 507 receives the sensor detection information from cordless phone master device 100, and then, display/operation unit 503 receives, for example, a monitoring instruction from the user of smartphone 500 (S104).

When the monitoring instruction is received, wireless LAN control unit 507 of smartphone 500 starts wireless connection to monitoring camera 200. That is, wireless LAN control unit 507 of smartphone 500 and wireless LAN control unit 221 of monitoring camera 200 perform control to perform the wireless connection (S105).

When smartphone 500 and monitoring camera 200 are wirelessly connected, wireless LAN control unit 221 of monitoring camera 200 transmits image stream data i106 containing an image or voice captured by imaging unit 201 to cordless phone master device 100 via the wireless LAN (S106).

Wireless LAN control unit 121 of cordless phone master device 100 transmits the image stream data from monitoring camera 200 to smartphone 500 via the wireless LAN (S107). Image memory control unit 114 of cordless phone master device 100 may write (record) the image stream data from monitoring camera 200 to the image memory.

In smartphone 500, wireless LAN control unit 507 receives the image stream data from cordless phone master device 100. Then, for example, display/operation unit 503 can display the image contained in the image stream data or the audio input and output control unit 505 can output the voice contained in the image stream data through speaker 513. Therefore, the user can monitor the image or the voice monitored by monitoring system 1000 using smartphone 500. In this case, for example, the user can confirm the opening and closing state of the window and estimate the presence or absence of an intruder.

Display/operation unit 503 may receive a remote operation of monitoring system 1000 from the user monitoring the image or the voice. For example, when display/operation unit 503 receives an operation (for example, a tap operation) of the "Speaker" key (S108), wireless LAN control unit 507 transmits operation information corresponding to the "Speaker" key to cordless phone master device 100 (S109).

In cordless phone master device 100, when wireless LAN control unit 121 receives the operation information corresponding to the "Speaker" key from smartphone 500, monitoring function control unit 113 executes predetermined control. For example, master device fixed line connection is included in this predetermined control.

In smartphone 500, for example, when display/operation unit 503 receives an operation (for example, tap operation) of the "Mute" key (S110, wireless LAN control unit 507 transmits operation information corresponding to the "Mute" key to cordless phone master device 100 (5111).

In cordless phone master device 100, when wireless LAN control unit 121 receives the operation information corresponding to the "Mute" key from smartphone 500, monitoring function control unit 113 executes predetermined control. For example, muting of transmitted voice is included in this predetermined control.

Next, security control in cordless phone master device 100 will be described.

Figure 8:
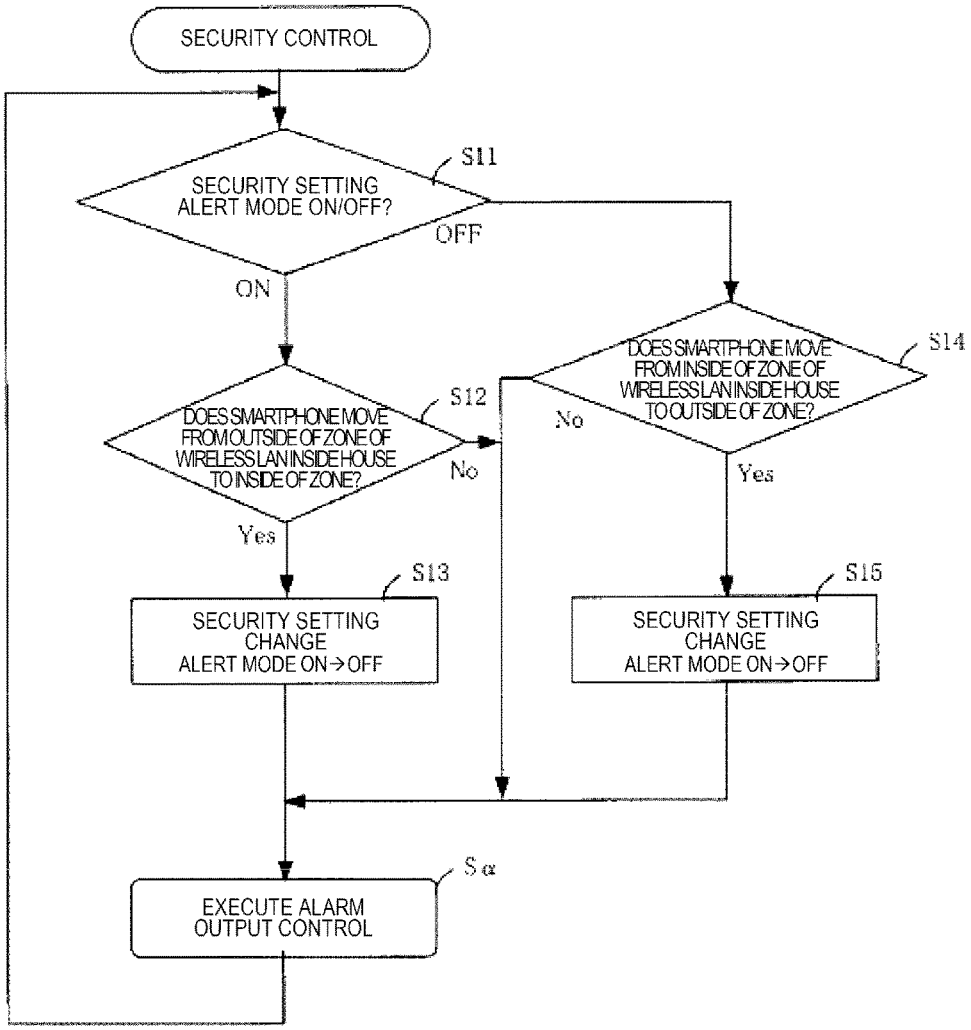
FIG. 8 is a flow diagram illustrating an example of security control in the cordless phone master device in the exemplary embodiment.

FIG. 8 is a flowchart illustrating an example of security control in cordless phone master device 100. For example, for security control of monitoring system 1000, for example, monitoring function control unit 113 of cordless phone master device 100 executes the security control.

Monitoring function control unit 113 identifies a setting state (ON and OFF state) of the alert mode for a current security setting state of monitoring system 1000 (S11). In monitoring system 1000, for example, when a user is inside house 10 (at home), the "alert mode" is set to OFF, and when the user goes out and is not inside house 10, the alert mode is set to ON.

When the alert mode is ON, monitoring function control unit 113 identifies whether smartphone 500 moves from the outside of the communication zone of the wireless LAN inside house 10 to the inside of the communication zone (S12). In other words, for example, monitoring function control unit 113 identifies whether wireless communication between cordless phone master device 100 and smartphone 500 via the wireless LAN inside house 10 is changed from a state in which the wireless communication is impossible to a state in which wireless communication is possible.

When it is identified that smartphone 500 moves from the outside of the communication zone of the wireless LAN inside house 10 to the inside of the communication zone, monitoring function control unit 113 changes the security setting of monitoring system 1000 (S13). In this case, monitoring function control unit 113 switches the alert mode from ON to OFF.

In S13, for example, the following situation is assumed. Since cordless phone master device 100 recognizes that smartphone 500 moves to the inside of the communication zone of the wireless LAN inside house 10, it is estimated that the user of smartphone 500 is at home. Therefore, even when the alert mode is at least temporarily turned OFF (released), security is highly likely not to be degraded. Since the alert mode is released, the user of smartphone 500 can be prevented from being erroneously recognized as an intruder at home and the alarm of monitoring system 1000 can be prevented from being generated.

When the alert mode is ON in S11, monitoring function control unit 113 identifies whether smartphone 500 moves from the inside of the communication zone of the wireless LAN inside house 10 to the outside of the communication zone (S14). In other words, for example, monitoring function control unit 113 identifies whether wireless communication between cordless phone master device 100 and smartphone 500 via the wireless LAN inside house 10 is changed from a state in which the wireless communication is possible to a state in which wireless communication is impossible.

When it is identified that smartphone 500 moves from the inside of the communication zone of the wireless LAN inside house 10 to the outside of the communication zone, monitoring function control unit 113 changes the security setting of monitoring system 1000 (S15). In this case, monitoring function control unit 113 switches the "alert mode" from OFF to ON. The alert in monitoring system 1000 is started.

In S15, the following situation is assumed, for example. Since cordless phone master device 100 recognizes that smartphone 500 moves to the outside of the communication zone (for example, to the outside of the house) of the wireless LAN inside house 10, it is estimated that the user of smartphone 500 is going out. Therefore, it is considered that it is highly necessary for monitoring system 1000 to start the alert so as to secure security inside house 10. Since the alert mode is started, an operation to turn the alert mode ON when the user of smartphone 500 goes out is not necessary, and convenience for the user improves. Further, even when the user goes out without performing the operation to turn the alert mode ON, it is possible to secure the security without the user coming back to house 10.

After the process of S13 or S15, monitoring function control unit 113 may perform the alarm output control (Su). The alarm output control will be described below in detail. The alarm output control may be omitted.

According to the process of FIG. 8, the alert mode of monitoring system 1000 can be set according to a position in which smartphone 500 is estimated to be present. For example, when the user of smartphone 500 goes out, the alert mode is switched to ON since smartphone 500 is outside the communication zone of the wireless LAN. For example, when the user comes home, the alert mode is switched to OFF since smartphone 500 is inside the communication zone of the wireless LAN. Therefore, it is possible to suppress degradation of the security of the monitoring target region and to improve the convenience for the user related to the setting of the alert mode.

Figure 13:
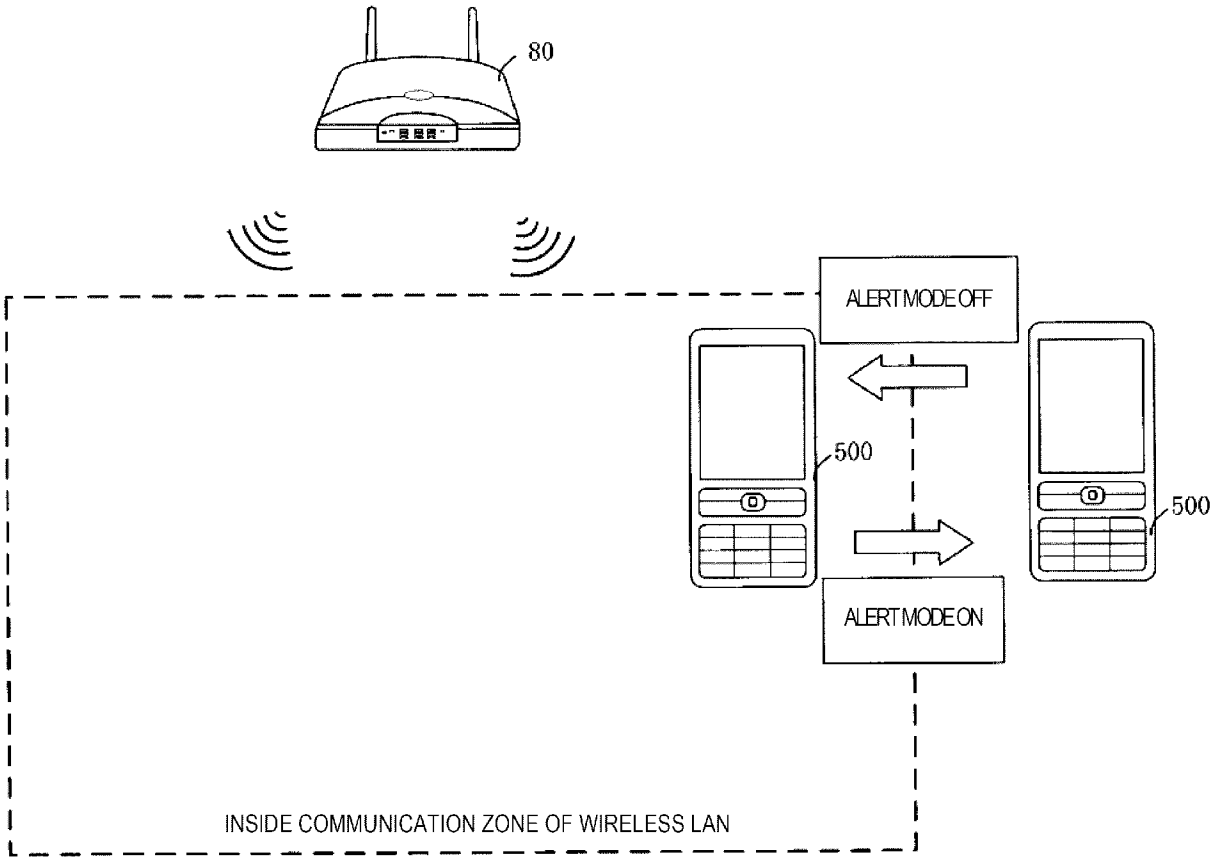
FIG. 13 is a schematic diagram illustrating a specific example of a positional relationship among a communication zone of a wireless LAN, the cordless phone master device, and the smartphone in the exemplary embodiment.

FIG. 13 is a schematic diagram illustrating a specific example of a positional relationship among the communication zone of the wireless LAN in monitoring system 1000, cordless phone master device 100, and smartphone 500.

When smartphone 500 moves from the outside of the communication zone of the wireless LAN inside house 10 to the inside of the communication zone, the alert mode of monitoring system 1000 is released (alert mode OFF). When smartphone 500 moves from the inside of the communication zone of the wireless LAN inside house 10 to the outside of the communication zone, the alert mode of monitoring system 1000 is started (alert mode ON).

Next, the alarm output control in cordless phone master device 100 will be described.

Figure 9:
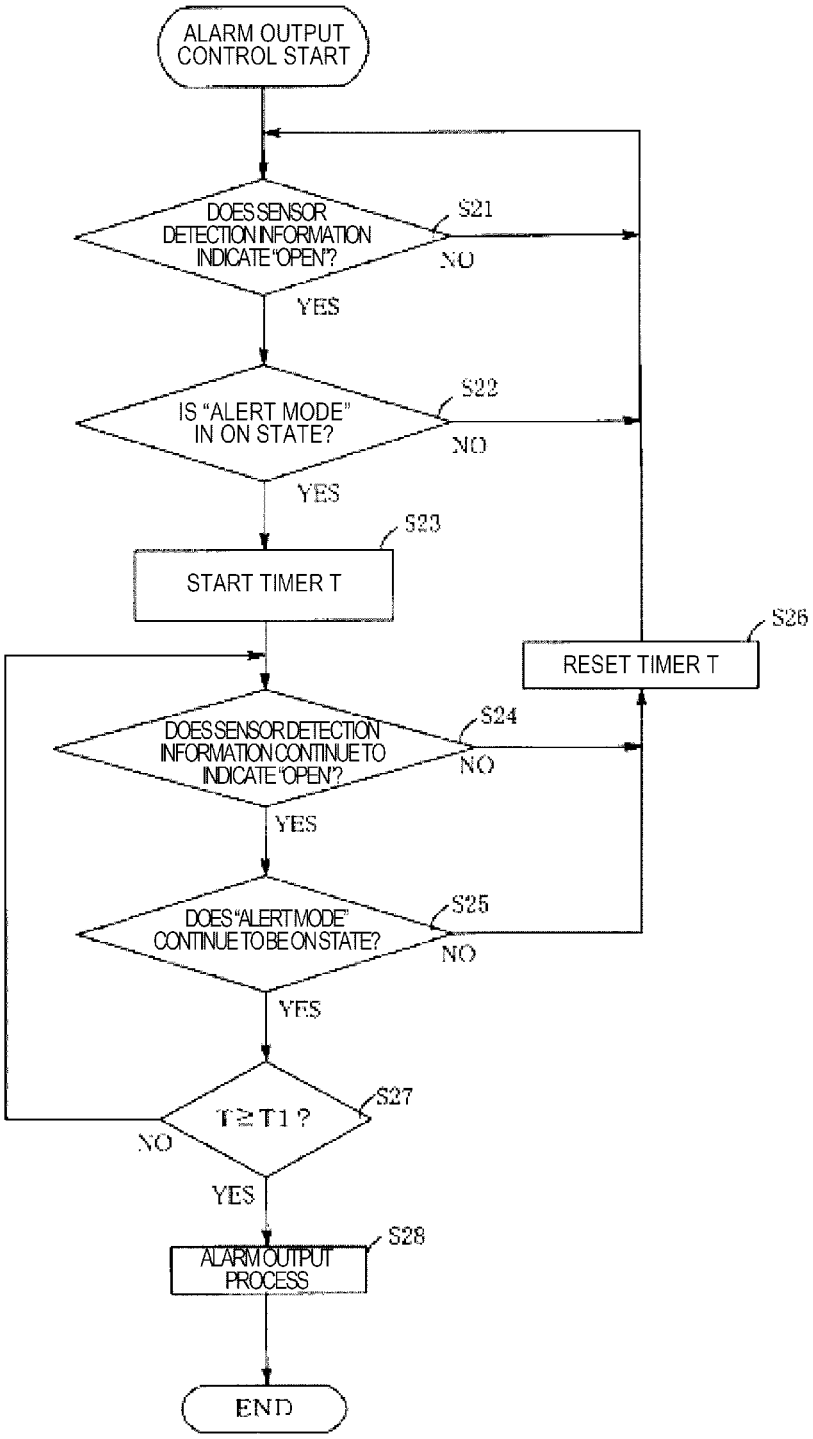
FIG. 9 is a flow diagram illustrating a first example of an alarm output control in the cordless phone master device in the exemplary embodiment.

FIG. 9 is a flowchart illustrating a first example of the alarm output control in cordless phone master device 100. The process of FIG. 9 may be performed alone separately from the process of FIG. 8.

First, monitoring function control unit 113 identifies, for example, an opening and closing state of the window by referring to the sensor detection information from opening and closing sensor 300 (S21).

For example, when the window is in an open state, monitoring function control unit 113 identifies the set alert mode by referring to the internal memory of monitoring function control unit 113 (S22).

When the alert mode is ON, monitoring function control unit 113 starts counting of the timer T built into the microcomputer or the like of master device control unit 109 (S23). That is, the timer T measures an elapsed time after opening and closing sensor 300 detects the open state.

Monitoring function control unit 113 identifies whether the open state continues, for example, by referring to the sensor detection information that is acquired regularly (S24).

When the open state continues, monitoring function control unit 113 identifies whether the ON state of the alert mode continues (S25).

When the open state continues in S24 or when the ON state of the alert mode continues in S25, monitoring function control unit 113 resets the timer T (S26).

When the ON state of the alert mode continues, monitoring function control unit 113 identifies whether a count value of the timer T is equal to or greater than a predetermined threshold value T1 (T≥T1) (S27). The threshold value T1 is, for example, 10 seconds. When the count value of the timer T is not equal to or greater than the predetermined threshold value T1, the process proceeds to S24. The threshold value T1 is an example of a first time.

When the count value of the timer T is equal to or greater than the predetermined threshold value T1, monitoring function control unit 113 executes a predetermined alarm output process (S28). In this case, for example, monitoring function control unit 113 may output alarm sound using speaker 129. Monitoring function control unit 113 display, for example, an alarm image using display unit 106. Monitoring function control unit 113 may store, for example, the image stream data from monitoring camera 200 as data having high importance. Monitoring function control unit 113 may notify, for example, smartphone 500 of occurrence of abnormality using an E-mail or the like. Therefore, for example, wireless LAN control unit 121, wireless LAN communication I/F unit 122, speaker 129, and display unit 106 are examples of the alarm output unit.

According to the process of FIG. 9, cordless phone master device 100 outputs the alarm when the predetermined time T1 lapses after the open state is detected by opening and closing sensor 300 in a state in which the alert mode is ON. Therefore, even when the predetermined threshold value T1 is relatively short, the alarm of monitoring system 1000 is not output even though the user of smartphone 500 does not operate the release of "the alert mode" in a hurry when the user of smartphone 500 comes home. Further, the alert mode can be switched to ON even when the user forgets to operate the security setting of monitoring system 1000 when the user goes out.

Figure 10:
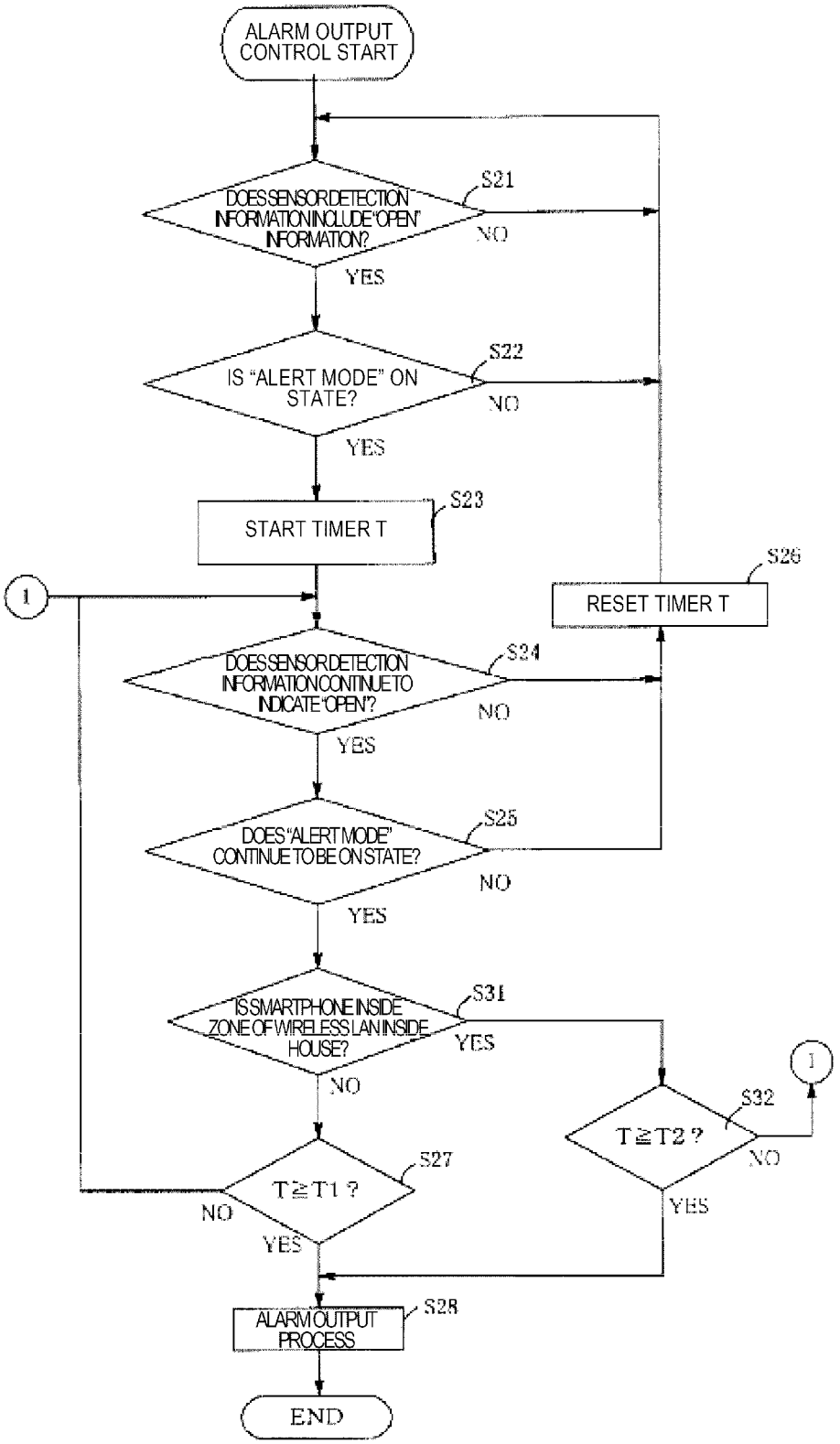
FIG. 10 is a flow diagram illustrating a second example of the alarm output control in the cordless phone master device in the exemplary embodiment.

FIG. 10 is a flowchart illustrating a second example of the alarm output control in cordless phone master device 100. In FIG. 10, the same steps as those illustrated in FIG. 9 are denoted with the same step numbers, and description thereof will be omitted or simplified. The process of FIG. 10 may be performed alone separately from the process of FIG. 8.

First, monitoring function control unit 113 executes a process of S21 to S26.

When the ON state of the alert mode continues in S25, monitoring function control unit 113 identifies whether there is smartphone 500 outside the communication zone of the wireless LAN inside house 10 (S31).

When there is smartphone 500 inside the communication zone of the wireless LAN inside house 10, monitoring function control unit 113 executes a process of S27.

When there is smartphone 500 outside the communication zone of the wireless LAN inside house 10, monitoring function control unit 113 identifies whether the count value of the timer T is equal to or greater than a predetermined threshold value T2 (T≥T2) (S27). For example, the threshold value T1 is 30 seconds. When the count value of the timer T is not is equal to or greater than the predetermined threshold value T2, the process proceeds to S24. Threshold T2 is an example of a second time.

According to the process of FIG. 10, when smartphone 500 is located outside the wireless LAN communication zone in a state in which the alert mode is an ON state, cordless phone master device 100 outputs the alarm when the predetermined time T1 lapses after the open state is detected by opening and closing sensor 300. Further, when smartphone 500 is located inside the wireless LAN communication zone, cordless phone master device 100 outputs the alarm when a predetermined time T2 lapses after the open state is detected by opening and closing sensor 300. That is, a length of the alert output time before output of the alarm is switched according to whether smartphone 500 is located inside the communication zone of the wireless LAN communication or located outside the communication zone.

Accordingly, even when the user forgets to turn the alert mode OFF, the alarm output time is changed to be lengthened according to success of the wireless LAN communication of smartphone 500 when the user comes home. Therefore, the output of the alarm of monitoring system 1000 immediately after the user comes home can be suppressed, and the user has a time margin before releasing the alert mode through a manual operation. Further, since the alarm output time is shortened while the user is going out, degradation of intruder detection performance can be suppressed. Therefore, it is possible to adjust the alarm output time according to a motion of the user and to suppress degradation of the security inside house 10 to improve convenience for the user.

The alert mode of monitoring system 1000 may be turned OFF (released) by a manual operation. For example, inputting a password registered in advance using ten keys of cordless phone master device 100 is considered as a method of manually releasing the alert mode.

Next, an operation example of smartphone 500 will be described.

Figure 11:
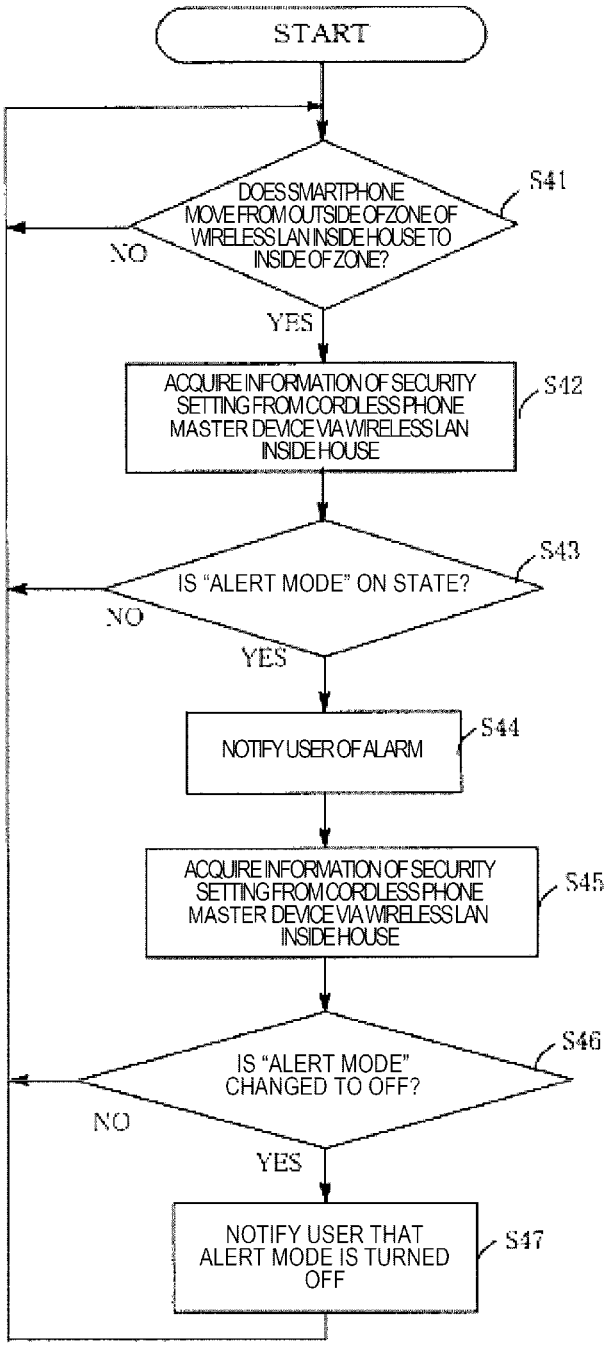
FIG. 11 is a flow diagram illustrating an operation example of the smartphone when the smartphone cooperates with the monitoring system in the exemplary embodiment.

FIG. 11 is a flowchart illustrating an operation example of smartphone 500. Smartphone 500 executes, for example, a process of FIG. 11 when smartphone 500 cooperates with monitoring system 1000.

Monitoring function control unit 514 identifies whether wireless communication with cordless phone master device 100 via wireless LAN control unit 507, wireless LAN communication I/F unit 508, and the wireless LAN inside house 10 illustrated in FIG. 1 is changed from a state in which the wireless communication is impossible to a state in which the wireless communication is possible (S41). That is, monitoring function control unit 514 identifies whether smartphone 500 moves from the outside of the communication zone of the wireless LAN inside house 10 to the inside of the communication zone.

When smartphone 500 moves from the outside of the communication zone of the wireless LAN inside house 10 to the inside of the communication zone, monitoring function control unit 514 acquires the information of the security setting of monitoring system 1000 from cordless phone master device 100 via the wireless LAN (S42).

Monitoring function control unit 514 identifies whether the alert mode is ON by referring to the received information of the security setting (S43). A case in which the alert mode is ON in S43 includes, for example, a case in which the alert mode is turned ON through a remote operation of smartphone 500.

When the alert mode is ON, monitoring function control unit 514 performs control to notify the user of alarm (notification information) including the fact that the alert mode of monitoring system 1000 is in an ON state (S44). In this case, monitoring function control unit 514, for example, causes display/operation unit 503 to display the notification information, notification sound to be output from speaker 513, or vibration indicating the notification information to be generated by a vibration device. Therefore, display/operation unit 503, speaker 513, or the vibration device (not illustrated) is an example of a notification unit of the portable terminal.

Monitoring function control unit 514 acquires the information of the security setting of monitoring system 1000 from cordless phone master device 100 via the wireless LAN inside house 10 again (S45). Monitoring function control unit 514 identifies whether the alert mode is changed to OFF by referring to the received information of the security setting (S46).

When the alert mode is changed to OFF, the alert mode is switched from ON to OFF by cordless phone master device 100, as shown in the process of S13 of FIG. 8. When the alert mode is switched to OFF, monitoring function control unit 514 performs control to notify the user of an alarm (notification information) including that fact that the alert mode of monitoring system 1000 has been released (has been turned OFF) (S47). In this case, monitoring function control unit 514, for example, causes display/operation unit 503 to display the notification information, notification sound to be output from speaker 513, or vibration indicating the notification information to be generated by the vibration device.

According to the process of FIG. 11, the user can confirm a setting state of the alert mode of monitoring system 1000 using smartphone 500. For example, when the user carrying smartphone 500 comes home, the user can recognize that the alert mode is ON. Therefore, for example, it is possible to increase possibility of the user being able to release the alert mode of monitoring system 1000 without forgetting to release the alert mode through a manual operation or to release the alert mode through a manual operation before the alarm is output. For example, when the user carrying smartphone 500 comes home, the alert mode is turned OFF without the user performing the manual operation of the security setting, and it can be recognized that the alert mode is turned OFF.

Smartphone 500 may remotely control the setting or releasing of the alert mode. In this case, for example, monitoring function control unit 514 identifies whether an input operation from the user to turn the alert mode ON is received through display/operation unit 503. When the instruction to turn the alert mode ON (alert mode start instruction) is received, monitoring function control unit 514, for example, connects a communication line with cordless phone master device 100 over Internet 60, and transmits the alert mode start instruction to cordless phone master device 100. Monitoring function control unit 514 may transmit the alert mode start instruction to cordless phone master device 100 over mobile phone network 50 and fixed telephone network 40 in place of Internet 60. Similarly, monitoring function control unit 514 may transmit an instruction to turn (release) the alert mode OFF.

Accordingly, smartphone 500 can remotely control monitoring system 1000. That is, the user can operate smartphone 500 from the outside of the house to set the alert mode of monitoring system 1000. Therefore, for example, even when the user forgets to turn the alert mode of monitoring system 1000 ON and goes out, the user can turn the alert mode ON to start alert through a remote operation from smartphone 500.

Figure 12:
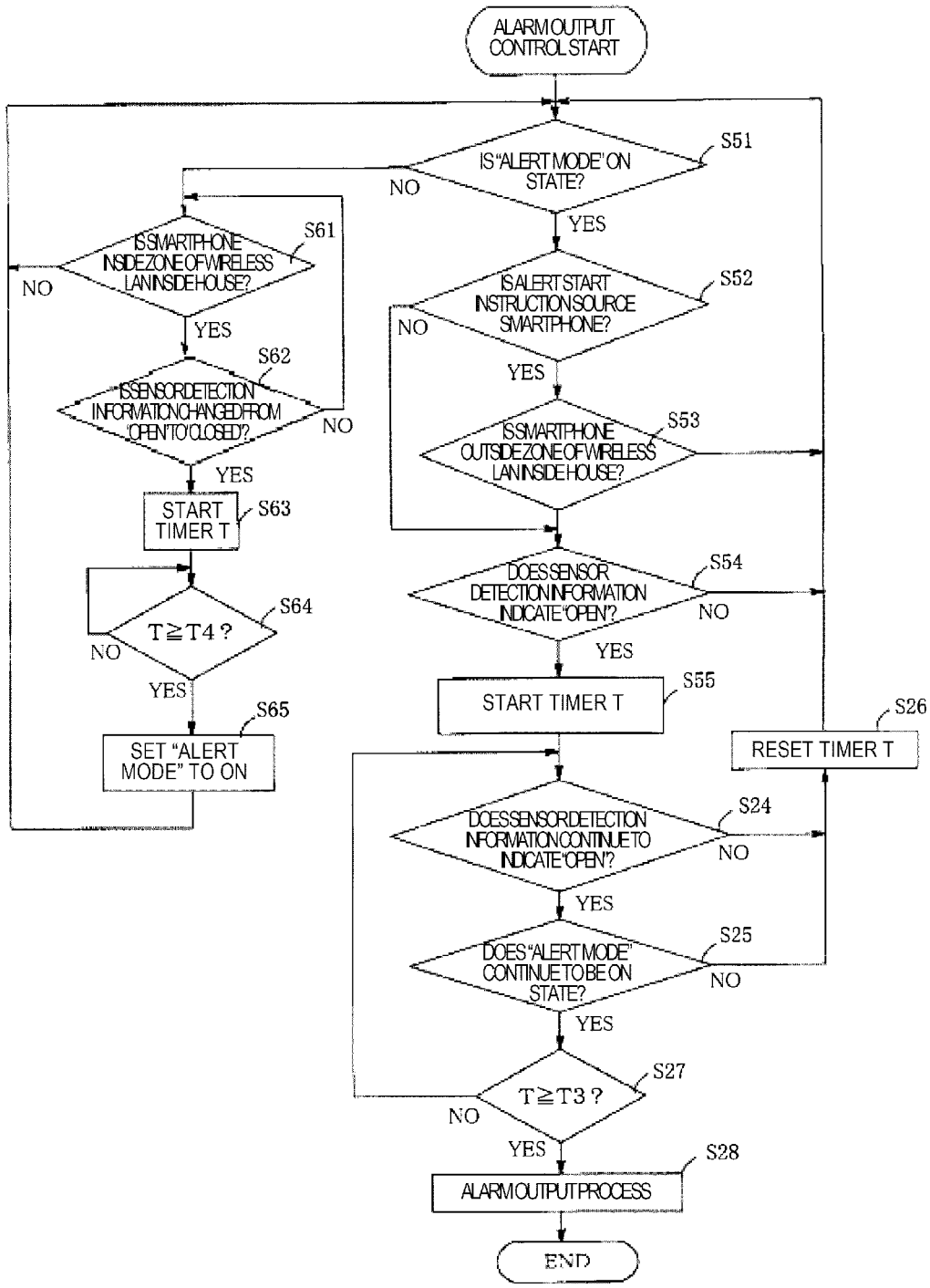
FIG. 12 is a flow diagram illustrating a third example of the alarm output control in the cordless phone master device in the exemplary embodiment.

FIG. 12 is a flowchart illustrating a third example of the alarm output control in cordless phone master device 100. In FIG. 12, the same steps as those shown in FIG. 9 or 10 are denoted with the same step numbers and description thereof will be omitted or simplified. The process of FIG. 12 may be performed alone separately from the process of FIG. 8.

Monitoring function control unit 113 identifies the setting state of the alert mode of monitoring system 1000 (S51).

When the alert mode is ON, monitoring function control unit 113 identifies whether the alert mode has been turned ON (alert has been started) due to the instruction of smartphone 500 (S52). For example, when monitoring function control unit 113 switches the alert mode to ON in response to the alert mode start instruction transmitted from smartphone 500, monitoring function control unit 113 can identify that an instruction source is smartphone 500. Monitoring function control unit 113 may hold information of the instruction source for switching of the alert mode in an internal memory and appropriately refer to the information.

When the ON state of the alert mode is caused by the instruction of smartphone 500, monitoring function control unit 113 identifies whether wireless communication with smartphone 500 via the wireless LAN inside house 10 is impossible (S53). That is, monitoring function control unit 113 identifies whether smartphone 500 is located outside the communication zone of the wireless LAN inside house 10.

When the ON state of the alert mode is not caused by the instruction of smartphone 500 in S52 or when smartphone 500 is outside the communication zone of the wireless LAN inside house 10 in S53, monitoring function control unit 113 refers to the sensor detection information from opening and closing sensor 300. Monitoring function control unit 113 identifies an opening and closing state based on the sensor detection information (S54). When the opening and closing state is "open," the process proceeds to S55, and when the opening and closing state is "closed," the process returns to S51.

When the sensor detection information indicates the open state, monitoring function control unit 113 starts counting of the timer T (S55).

When the process of S55 ends, monitoring function control unit 113 executes a process of S24 to S28. However, in S27 of FIG. 12, monitoring function control unit 113 identifies whether the count value of the timer T is equal to or greater than a predetermined threshold value T3 (T≥T3). The threshold value T3 is, for example, 10 seconds. The threshold value T3 is an example of a third time.

When the alert mode is OFF in S51, monitoring function control unit 113 identifies whether wireless communication with smartphone 500 via the wireless LAN inside house 10 is possible (S61). That is, monitoring function control unit 113 identifies whether smartphone 500 is located inside the communication zone of the wireless LAN inside house 10.

In step S62, monitoring function control unit 113 identifies whether the information included in the sensor detection information is changed from the open state to the closed state by referring to the sensor detection information from opening and closing sensor 300 (S62).

When the information included in the sensor detection information is changed to the closed state, monitoring function control unit 113 starts counting of the timer T (S63).

Monitoring function control unit 113 identifies whether a count value of the timer T is equal to or greater than a predetermined threshold value T4 (T≥T4) (S64). The threshold value T4 is, for example, 10 seconds. When the count value of the timer T is not equal to or greater than the predetermined threshold value T4, S64 is repeated. The threshold value T4 is an example of a fourth time.

When the count value of the timer T is equal to or greater than the predetermined threshold value T4, monitoring function control unit 113 turns the alert mode ON (S65). That is, monitoring function control unit 113 switches the alert mode to ON even without an operation by the user of cordless phone master device 100 or an instruction from an external device (for example, smartphone 500).

According to the process of FIG. 12, for example, the alarm can be output according to the alarm output time when the alert mode is turned ON through a remote operation of smartphone 500. Therefore, for example, when the alarm output time suitable for a remote operation of smartphone 500 is set, it is possible to improve convenience for the user. Further, the alert mode is switched to ON according to detection of the closed state by opening and closing sensor 300 while the user of smartphone 500 is at home. Therefore, since alert of house 10 where there is the user can be started without turning the alert mode ON through a manual operation, it is possible to secure security and improve convenience for the user.

The present invention is not limited to the configuration of the above-described exemplary embodiment, and any configuration that can be accomplished by functions shown in claims or functions of the configuration of this exemplary embodiment can be applied.

For example, in the above-described exemplary embodiment, installation of at least some of the sensors may be omitted in monitoring system 1000.

For example, while the wireless LAN has been illustrated as a communication line of the wireless communication between cordless phone master device 100 and smartphone 500 in the above-described exemplary embodiment, another communication line of short range wireless communication (for example, Bluetooth (registered trademark)) may be used.

For example, in the above-described exemplary embodiment, a mobile phone, a tablet terminal, a PC (Personal Computer), or other portable terminals may be provided in place of smartphone 500. These devices have the same functions as those of smartphone 500.

For example, in the above-described exemplary embodiment, a device other than the cordless phone master device 100 may operate as the control device of the communication system.

For example, in the above-described exemplary embodiment, the case in which monitoring system 1000 performs the setting of ON and OFF of the alert mode, the control of the alarm output time, or the like according to the positional relationship between smartphone 500 and cordless phone master device 100 has been illustrated. There may be a general monitoring system that monitors the monitoring target region, separately from monitoring system 1000. In this case, monitoring system 1000, for example, may determine ON and OFF of the alert mode by the general monitoring system according to the positional relationship between smartphone 500 and cordless phone master device 100, and notify the general monitoring system of the determination. Further, monitoring system 1000, for example, may determine a length of the alarm output time according to the alarm output by the general monitoring system according to the positional relationship between smartphone 500 and cordless phone master device 100, and notify the general monitoring system of the determination.

What is claimed is:

1. A monitoring system comprising:

a sensor coupled to a communicator; and a master device which, in operation, performs wireless communication with the sensor according to a wireless communications protocol, and is connected to a fixed telephone network to communicate with other fixed telephones, wherein the master device includes:

a first communicator which, in operation, performs wireless communication via a wireless router with a smartphone that is connected to a mobile phone network to communicate with other mobile telephones, a second communicator which, in operation, receives detection signal from the sensor according to the wireless communications protocol, a controller which sets the master device in a first alert mode in response to detecting that the smartphone is outside a wireless communication range of the first communicator, and sets the master device in a second alert mode in response to detecting that the smartphone is inside the wireless communication range of the first communicator, and an alarm output which issues an alarm when the detection signal received from the sensor indicates an abnormal state;

wherein an alarm output period, which starts when the master device begins to receive the detection signal indicative of the abnormal state and ends when the master device outputs the alarm, is set longer in the second alert mode than in the first alert mode.

2. The monitoring system of claim 1, wherein the sensor and the master device communicate with each other according to a DECT (Digital Enhanced Cordless Telecommunications) protocol.

3. The monitoring system of claim 1, wherein the sensor is an infrared sensor.

4. The monitoring system of claim 1, wherein the sensor is selected from a group consisting of a human sensor, a smoke sensor, an opening/closing sensor, and a smart plug.

5. The monitoring system of claim 1, wherein the sensor is a human sensor, and the abnormal state indicates detection of a person.

6. The monitoring system of claim 1, wherein the sensor is a smoke sensor, and the abnormal state indicates detection of smoke.

7. The monitoring system of claim 1, wherein the sensor is an opening/closing sensor, and the abnormal state indicates an open state detected by the opening/closing sensor.

8. The monitoring system of claim 1, wherein the sensor is a smart plug, and the abnormal state indicates that an amount of power used in a house as detected by the smart plug has exceeded a threshold amount.

9. The monitoring system of claim 1, wherein the alarm includes one or more of a visual alarm, an audio alarm, and a vibration alarm.

10. A monitoring method based on a monitoring system, the monitoring system comprising: (a) a sensor coupled to a communicator; and (b) a master device which, in operation, performs wireless communication with the sensor according to a wireless communications protocol, and is connected to a fixed telephone network to communicate with other fixed telephones, wherein the master device includes: (b-i) a first communicator which, in operation, performs wireless communication via a wireless router with a smartphone that is connected to a mobile phone network to communicate with other mobile telephones, and (b-ii) a second communicator which, in operation, receives detection signal from the sensor according to the wireless communications protocol, the monitoring method comprising:

setting the master device in a first alert mode when the smartphone is outside a wireless communication range of the first communicator, setting the master device in a second alert mode when the smartphone is inside the wireless communication range of the first communicator, issuing an alarm from the master device in the first alert mode after a first alarm output period, which starts when the master device begins to receive the detection signal indicative of an abnormal state from the sensor and ends when the master device outputs the alarm, and issuing the alarm from the master device in the second alert mode after a second alarm output period, which starts when the master device begins to receive the detection signal indicative of an abnormal state from the sensor and ends when the master device outputs the alarm, wherein the second alarm output period is longer than the first alarm output period.

* * * * *